US007351039B2

(12) United States Patent
Bachofner et al.

(10) Patent No.: US 7,351,039 B2
(45) Date of Patent: Apr. 1, 2008

(54) COMPRESSOR ROTOR BLADE

(75) Inventors: René Bachofner, Untersiggenthal (CH); Wolfgang Kappis, Fislisbach (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 10/983,225

(22) Filed: Nov. 8, 2004

(65) Prior Publication Data

US 2005/0106030 A1 May 19, 2005

(30) Foreign Application Priority Data

Nov. 8, 2003 (DE) ..... 103 52 253

(51) Int. Cl.
*F04D 29/38* (2006.01)

(52) U.S. Cl. ..... 416/228; 416/223 A

(58) Field of Classification Search ..... 416/228, 416/235, 223 A, 237
See application file for complete search history.

(56) References Cited

U.S. PATENT DOCUMENTS 2,801,790 A * 8/1957 Doll, Jr. ..... 415/210.1
4,671,738 A * 6/1987 Freeman ..... 416/223 A
5,310,318 A * 5/1994 Lammas et al. ..... 416/219 R
6,059,532 A * 5/2000 Chen et al. ..... 416/223 A
6,142,739 A * 11/2000 Harvey ..... 416/235
6,264,429 B1 7/2001 Koeller et al.
6,338,609 B1 * 1/2002 Decker et al. ..... 415/173.1
6,666,654 B2 * 12/2003 Olhofer et al. ..... 416/228

FOREIGN PATENT DOCUMENTS

| | | |
|---|---|---|
| DE | 1 057 137 | 5/1959 |
| EP | 0 991 866 B1 | 8/2003 |
| GB | 833638 | 4/1960 |
| JP | 01159401 A * | 6/1989 |

OTHER PUBLICATIONS

Search Report from 103 52 253.0 (Apr. 29, 2004).

* cited by examiner

*Primary Examiner*—Edward K. Look
*Assistant Examiner*—Dwayne J White
(74) *Attorney, Agent, or Firm*—Cermak Kenealy & Vaidya LLP; Adam J. Cermak

(57) ABSTRACT

A compressor rotor blade (1) includes a rotor blade (2), a platform (3) that adjoins the rotor blade (2) and blade footing (4) that adjoins the platform (3). The rotor blade (4) is embodied so as to be massive, without an internal cooling system, and exhibits a leading and a trailing edge (5, 6), a suction and a compression side, as well as a blade tip (7). The compressor rotor blade (1) is distinguished by virtue of the fact that the rotor blade (2) of the compressor rotor blade (1) exhibits a recess (8) on the trailing edge (6) of the blade tip (7).

14 Claims, 2 Drawing Sheets

COMPRESSOR ROTOR BLADE

This application claims priority under 35 U.S.C. § 119 to German application number 103 52 253.0, filed 8 Nov. 2003, the entirety of which is incorporated by reference herein.

BACKGROUND OF THE INVENTION

1. Field of the Invention

The invention relates to a compressor rotor blade.

2. Brief Description of the Related Art

A compressor rotor blade in keeping with this type is known from European patent EP 0 991 866 B1. Such compressor rotor blades have the disadvantage that as a result of the excitation of high frequencies (lyra mode), they are made to oscillate in such a manner that the profiled tips, in particular, are exposed to an elevated mechanical stress. This can lead to considerable damage of the compressor rotor blades, even to breaking.

SUMMARY OF THE INVENTION

Therefore, the task of creating an extension of a compressor rotor blade such that the oscillatory behavior described above is diminished exists, so that damage as a consequence of excessive mechanical stress is precluded. The measures in question that are to be taken are to be as simple as possible in terms of construction and as cost-effective as possible in their realization.

According to principles of the present invention, this task can be resolved by a compressor rotor blade.

An underlying aspect of the present invention includes equipping the rotor blade with a recess at the blade tip, in an area in front of the trailing edge of the rotor blade. At the blade tip, proceeding from the blade's leading edge, the rotor blade exhibits, first of all, an untouched area, which makes a transition, by means of a shoulder in the form of a step or a rounding, to a recess extending as far as the trailing edge of the rotor blade.

In the case of a compressor rotor blade according to the invention, damages at the tip of the rotor blade tip due to the lyra mode are avoided to good advantage on the side of egress.

BRIEF DESCRIPTION OF THE DRAWINGS

Additional favorable embodiments and advantages of the invention are described below in exemplary fashion by virtue of one embodiment, making reference to the drawings.

Only those characteristics that are essential to the invention are shown.

DETAILED DESCRIPTION OF EXEMPLARY EMBODIMENTS

Figure 1:
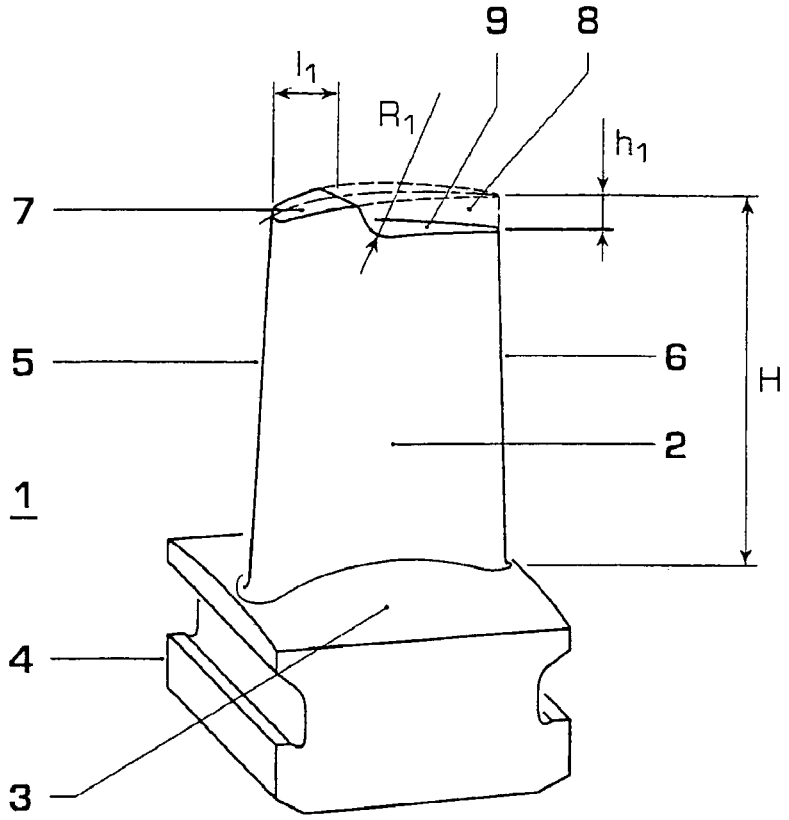
FIGS. 1-3 show three different embodiments of a compressor rotor blade according to the invention.

FIG. 1 shows an embodiment of a compressor rotor blade 1 according to the invention, which comprises a rotor blade 2, a platform 3 and a blade footing 4. The compressor rotor blades 1 are arranged across the circumference of a rotor (not depicted). They are not connected by means of a cover band. The rotor blade 2 of compressor rotor blade 1 exhibits a rotor blade tip 2, a leading edge 5, a trailing edge 6, as well as compression and a suction side. The compressor rotor blade 1 is configured massively and it exhibits no internal cooling system. According to the invention, the rotor blade 2 of compressor rotor blade 1 is equipped with a recess 8 at the blade tip 7. This recess 8 extends across an area of the blade tip 7 on the egress side, as far as the trailing edge 6, whereby the untouched length $l_1$ of the leading edge 5 of the compressor rotor blade 1 to the beginning of the recess constitutes 20% to 60%, preferably 30% to 50%, and particularly preferably, between 30% and 40% of the axial chord length of the compressor rotor blade 1. The transition from the untouched area of the blade tip 7 to the recess 8 is accomplished by means of a shoulder 9 in the form of a step, whereby, to avoid indentation effects, the edges of the shoulder 9 are embodied with a radius $R_1$ of about 2 mm to 5 mm. The surface of the blade within the recess 8 runs substantially parallel to the original contour of blade tip 7, which is indicated in the Figures by lines of dashes. The depth $h_1$ of the recess 8 is about 5% to 10% of the height H of the trailing edge 6. With this compressor rotor blade 1 according to the invention, damage to blade tip 7 at the egress side, due to the lyra mode at high frequencies, is avoided.

Figure 2:
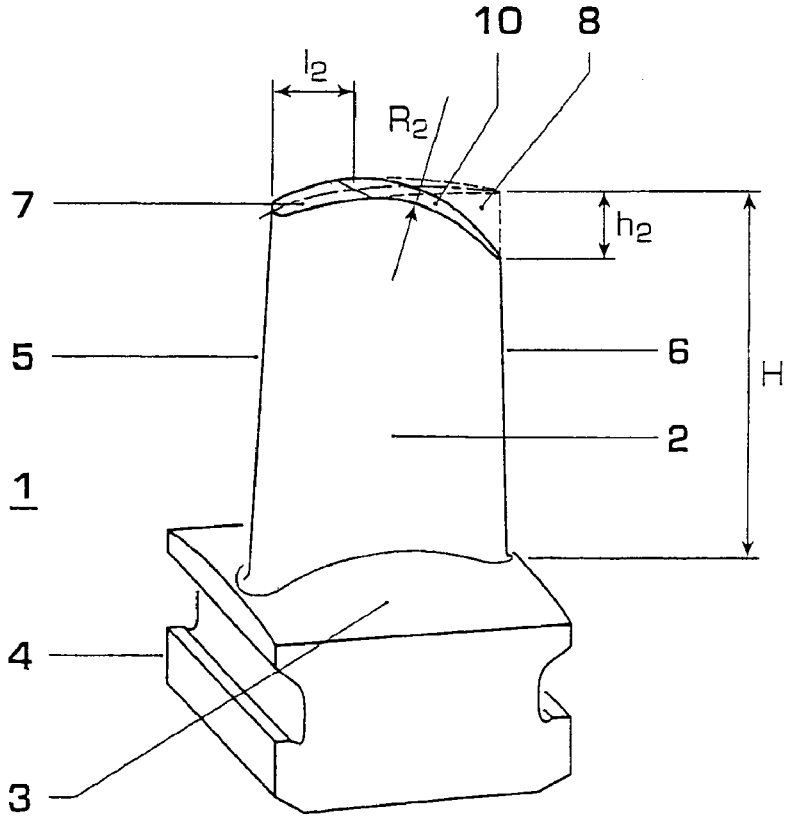

FIG. 2 shows an additional embodiment of a compressor rotor blade 1 according to the invention, whose essential characteristic consists of a recess 8 of the blade tip 7 on the egress side, configured as a rounding off 10. The transition from the blade tip 7 to the trailing edge 6 is constructed in the form of a rounding off 10 with a radius $R_2$, whereby $R_2$ corresponds to 0.5 to 1.5 times the chord length of blade 1. According to one favorable variant, blade tip 7 makes the transition to a radius $R_2$ in the trailing edge 6, which corresponds to the chord length. The area of the untouched length $l_2$ of blade tip 7 amounts, in this case, to about 50% to 80%, preferably 60% to 70% of the chord length. The depth $h_2$ of the recess 8 on the trailing edge will regularly lie beneath 30%, especially under 20%, preferably between 10% and 20% of the length of the trailing edge 6.

Figure 3:
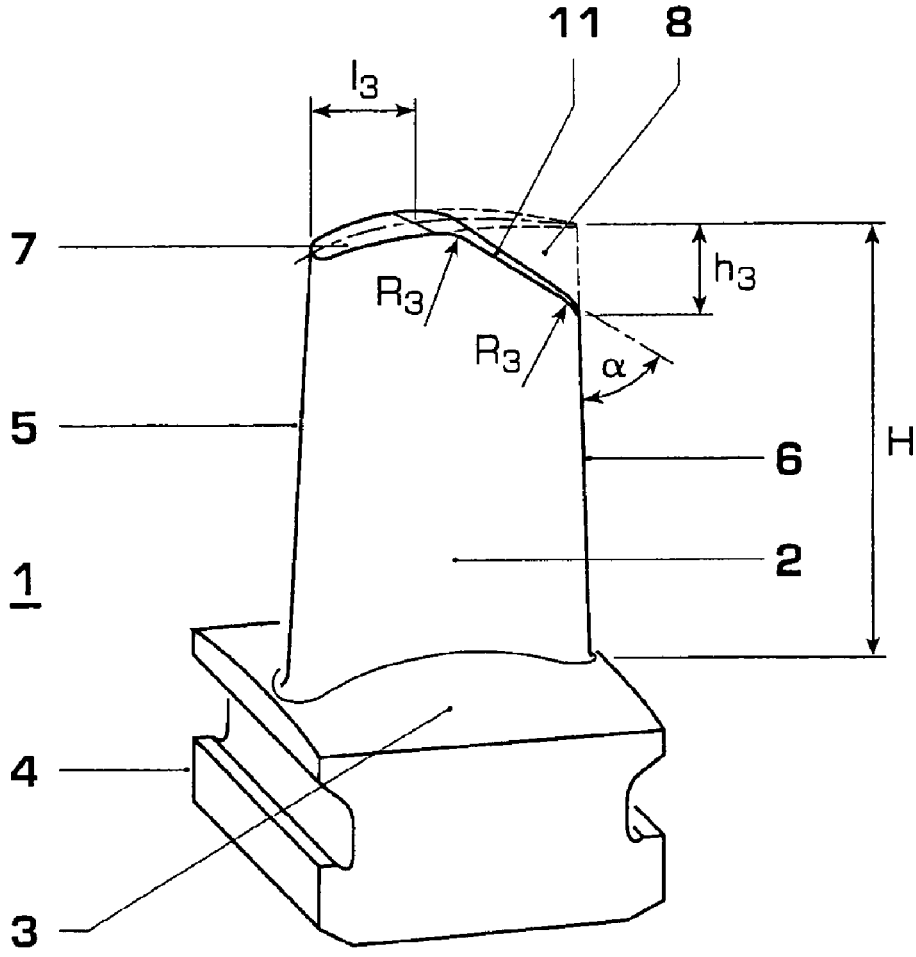

According to an additional alternative embodiment of a compressor rotor blade 1 according to FIG. 3, the blade tip on the egress side is formed by a slope 11, which makes the transition, in each case, through a rounding off having a radius $R_3$ at one end, to the blade tip 7, and at the other end, to the trailing edge 6. The slope 11 assumes an angle $\alpha$ of 20° to 60°, preferably of 30° to 45° to the trailing edge 6. In this embodiment, too, the untouched length $l_3$ of blade tip 7 is about 50% to 80%, preferably 60% to 70% of the axial chord length of blade $\mathbf{1}_2$. The depth $h_3$ of the recess 8 on the trailing edge 6 lies below 30%, preferably between 10% and 20% of the height H of the trailing edge 6. With this compressor rotor blade 1 according to the invention, in addition, damage to the blade tip on the egress side due to the lyra mode at high frequencies is avoided.

The saving in mass that results from recess 8 on the compressor rotor blade 1 is approximately identical in the embodiments according to the FIGS. 1 through 3.

List of Reference Symbols

1 Compressor rotor blade
2 Rotor blade
3 Platform
4 Blade footing
5 Leading edge
6 Trailing edge
7 Blade tip
8 Recess
9 Shoulder
10 Rounding off

11 Slope
$R_1$ Radius
$R_2$ Radius
$R_3$ Radius
$l_1$ untouched length
$l_2$ untouched length
$l_3$ untouched length
H Height of the trailing edge 6
$h_1$ Depth of recess on trailing edge 6
$h_2$ Depth of recess on trailing edge 6
$h_3$ Depth of recess on trailing edge 6

While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A compressor rotor blade comprising:

a blade footing;

a platform; and a massive rotor blade without an internal cooling system, the massive rotor blade including a free blade tip, a leading edge, a trailing edge, a compression side, a suction side, and a recess on the free blade tip that extends to the entirety of the trailing edge;

wherein the blade tip of the rotor blade includes a slope on an egress side toward the trailing edge of the blade; and wherein the slope assumes an angle ($\alpha$) of 20° to 60° to the trailing edge of the compressor rotor blade.

2. A compressor rotor blade according to claim 1, wherein the rotor blade includes a shoulder having a step at the blade tip.

3. A compressor rotor blade according to claim 2, wherein the untouched length ($l_1$) of the blade tip is about 20% to 60% of an axial chord length of the blade.

4. A compressor rotor blade according to claim 2, wherein the untouched length ($l_1$) of the blade tip is about 30% to 50% of an axial chord length of the blade.

5. A compressor rotor blade according to claim 2, wherein the shoulder includes a step and has a depth ($h_1$) of about 5% to 10% of a height (H) of the trailing edge of the blade.

6. A compressor rotor blade comprising:

a blade footing;

a platform; and a massive rotor blade without an internal cooling system, the massive rotor blade including a blade tip, a leading edge, a trailing edge, a compression side, a suction side, and a recess on the blade tip that extends to the trailing edge;

wherein the blade tip of the rotor blade includes a slope on an egress side toward the trailing edge of the blade, the slope assuming an angle ($\alpha$) of 20° to 60° to the trailing edge of the compressor rotor blade.

7. A compressor rotor blade according to claim 6, wherein the recess comprises straight lines arranged at the angle ($\alpha$) to the trailing edge of the blade, each of which lines makes a transition to the blade tip or to the trailing edge of the blade, the transition including a rounding having a radius ($R_3$).

8. A compressor rotor blade according to claim 6, wherein the untouched length ($l_3$) of the blade tip is about 50% to 80% of the axial chord length of the blade.

9. A compressor rotor blade according to claim 6, wherein the untouched length ($l_3$) of the blade tip is about 60% to 70% of the axial chord length of the blade.

10. A compressor rotor blade according to claim 6, wherein the depth of the recess is about 10% to 30% of the height (H) of the trailing edge of the blade.

11. A compressor rotor blade according to claim 6, wherein said angle ($\alpha$) is 30° to 45° to the trailing edge of the compressor rotor blade.

12. A compressor rotor blade according to claim 1, wherein the compressor rotor blade does not include a cover band.

13. A compressor rotor blade according to claim 2, wherein the untouched length ($l_1$) of the blade tip is about 30% to 40% of an axial chord length of the blade.

14. A compressor rotor blade according to claim 6, wherein the depth of the recess is about 10% to 20% of the height (H) of the trailing edge of the blade.

* * * * *